US006520754B2

(12) United States Patent
Randolphi

(10) Patent No.: US 6,520,754 B2
(45) Date of Patent: Feb. 18, 2003

(54) COMPRESSOR UNIT FOR REFRIGERATION

(75) Inventor: Peter P. M. Randolphi, Newmarket (CA)

(73) Assignee: Randell Technologies Inc., Ontario (CA)

( * ) Notice: Subject to any disclaimer, the term of this patent is extended or adjusted under 35 U.S.C. 154(b) by 0 days.

(21) Appl. No.: 09/782,486

(22) Filed: Feb. 13, 2001

(65) Prior Publication Data

US 2002/0110466 A1 Aug. 15, 2002

(51) Int. Cl.[7] ..... F04B 17/00; F01C 1/02
(52) U.S. Cl. ..... 417/420; 417/410.3; 418/61.2
(58) Field of Search ..... 417/420, 410.3; 418/61.2; 62/6

(56) References Cited

U.S. PATENT DOCUMENTS 3,426,525 A * 2/1969 Rubin ..... 62/6
3,584,975 A 6/1971 Frohbieter ..... 417/420
3,656,875 A 4/1972 Luck ..... 418/54
3,680,984 A 8/1972 Young et al. ..... 417/420
4,018,548 A 4/1977 Berkowitz ..... 418/61.2
4,065,234 A 12/1977 Yoshiyuki et al. ..... 417/420
4,487,561 A 12/1984 Eiermann ..... 418/61.2
4,674,960 A * 6/1987 Rando et al. ..... 417/420
5,215,501 A * 6/1993 Ushikoshi ..... 417/420
5,310,325 A 5/1994 Gulyash ..... 418/61.2
5,334,004 A 8/1994 Lefevre et al. ..... 417/420
5,582,090 A * 12/1996 Poschl ..... 417/199.1
6,109,040 A * 8/2000 Ellison, Jr. et al. ..... 62/6
6,179,568 B1 * 1/2001 Phillips et al. ..... 417/420

* cited by examiner

*Primary Examiner*—Charles G. Freay
*Assistant Examiner*—Michael K. Gray
(74) *Attorney, Agent, or Firm*—Richard M. Goldberg

(57) ABSTRACT

A compressor for a refrigeration unit having a stator, a rotor orbiting in engagement with the stator to cyclically open, fill with refrigerant gas from at least one inlet port, compress and discharge compressed refrigerant gas through at least one discharge port, a rotary drive for orbiting the rotor, a driven element of a magnetic coupling in driving connection with the rotary drive, a casing sealed save for the ports and enclosing all of the foregoing components, a driving element of the magnetic coupling outside of the casing in close proximity to the driven element, and a motor to rotate the driving element.

Figure 1:
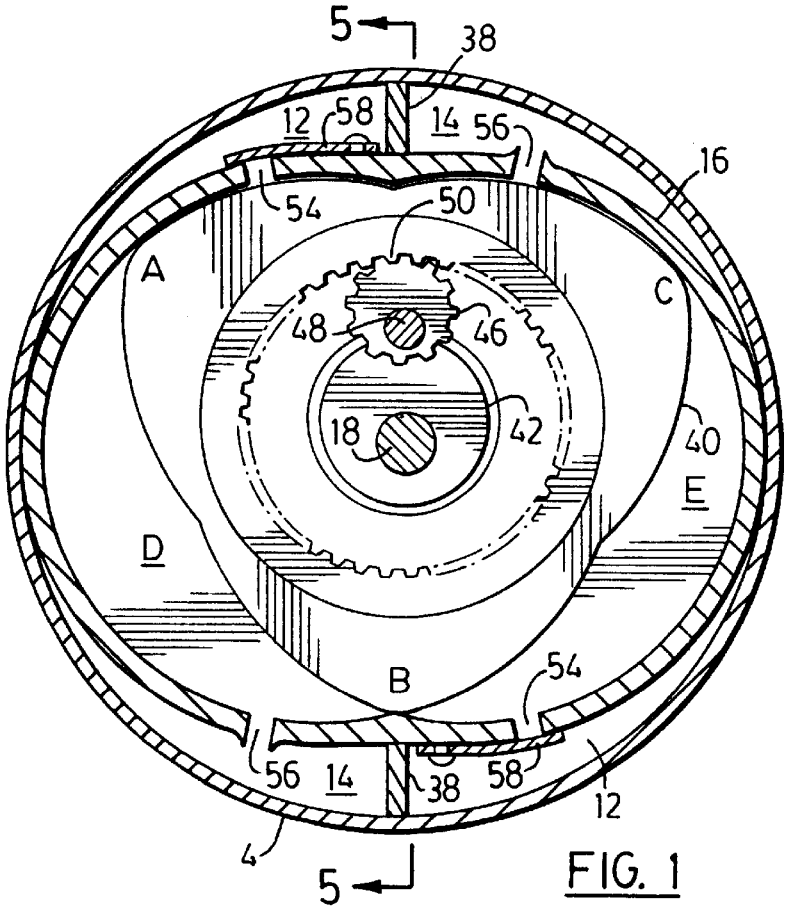

Preferably the rotor is a multilobed rotor orbiting within a trochoidal chamber defined by the stator. Most preferably, a three lobed rotor is journalled on an eccentric carried by a shaft of the rotary drive and has a ring gear driven by a gear of the rotary drive having the same eccentricity as the eccentric and rotated in synchronism therewith, the gear ratio of the ring gear to the eccentric being three to one.

6 Claims, 3 Drawing Sheets

COMPRESSOR UNIT FOR REFRIGERATION

FIELD OF THE INVENTION

This invention relates to refrigeration compressor units especially but not exclusively units for small refrigeration units such are suitable for use in domestic ice cream makers, small refrigerators and similar appliances. Such units must be compact, quiet, reliable and economical to manufacture and operate

BACKGROUND OF THE INVENTION

Compressor units for domestic refrigerators are commonly of the sealed unit type in which both the compressor and a motor permanently coupled to the compressor are located within an enclosure which is completely and permanently sealed except for refrigerant connections to the remainder of the refrigeration unit. Such a unit has the disadvantages that failure of either the motor or the compressor requires both to be discarded, different sealed units are required for electrical supplies requiring different motors, even though the compressor is identical, and two devices, both of which generate unwanted heat. are thermally coupled within the same enclosure.

It is known in compressor units for automotive air conditioning systems, which are engine driven, and thus require a clutch mechanism, to utilize an electromagnetic clutch between a belt driven pulley and the compressor.

it is also known to use magnetic couplings in drives for pumps so as to avoid the necessity of sealing a drive shaft entering the pump chamber. Examples of such arrangements are to be found in U.S. Pat. No. 3,584,975 (Frohbieter); U.S. Pat. No. 3,680,984 (Young et al.); U.S. Pat. No. 4,065,234 (Yoshiyuki et al.); and U.S. Pat. No. 5,334,004 (Lefevre et al), and in ISOCHEM (Trademark) pumps from Pulsafeeder. Although the first of the patents relates to a circulation pump for an absorption type air conditioning system, the use of a permanent magnet coupling in the drive to the compressor of a compressor type refrigeration unit has not to the best of my knowledge previously been proposed.

Reasons may include the sharply fluctuating torque required by piston type compressors normally used in such systems.

In the interests of smoother and more silent compression, there has been some adoption of scroll type compressors in compression type refrigeration units, available for example from Lennox, Copeland and EDPAC International.

An alternative form of piston compressor which has been proposed, although not to the best of my knowledge for refrigeration applications, is the rotary piston compressor using a lobed rotor in a trochoidal chamber and having some superficial resemblance to rotary piston engines such as the Wankel engine although the operating cycle is substantially different and the shaft is driven by an external power source rather than being driven by the rotary piston. Such compressors are exemplified in U.S. Pat. No. 3,656,875 (Luck); U.S. Pat. No. 4,018,548 (Berkowitz); and U.S. Pat. No. 4,487,561 (Eiermann).

U.S. Pat. No 5,310,325 (Gulyash) discloses a rotary engine using a symmetrical lobed piston moving in a trochoidal chamber on an eccentric mounted on a rotary shaft and driven through a ring gear by a similarly eccentric planet gear rotated at the same rate as the eccentric, the gear ratio of the ring gear to the planet gear being equal to the number of lobes on the rotor, typically three. The apices of the lobes trace trochoidal paths tangent to the trochoidal chamber wall thus simplifying sealing. There is no suggestion that similar principles of construction could be used in a compressor.

SUMMARY OF THE INVENTION

In its broadest aspect, the invention provides a compressor for a refrigeration unit having a stator, a rotor orbiting in engagement with the stator to cyclically open, fill with refrigerant gas from at least one inlet port, compress and discharge compressed refrigerant gas through at least one discharge port, a rotary drive for orbiting the rotor, a driven element of a magnetic coupling in driving connection with the rotary drive, a casing sealed save for the ports and enclosing all of the foregoing components, a driving element of the magnetic coupling outside of the casing in close proximity to the driven element, and means to rotate the driving element.

Preferably the rotor is a multilobed rotor orbiting within a trochoidal chamber defined by the stator, although a scroll type compressor with stationary and orbiting scrolls may also be utilized. Most preferably, a three lobed rotor is journalled on an eccentric carried by a shaft of the rotary drive and has a ring gear driven by a gear of the rotary drive having the same eccentricity as the eccentric and rotated in synchronism therewith, the gear ratio of the ring gear to the eccentric being three to one.

Further features of the invention will be apparent from the following description of a presently preferred embodiment thereof.

SHORT DESCRIPTION OF THE DRAWINGS

Figure 3:
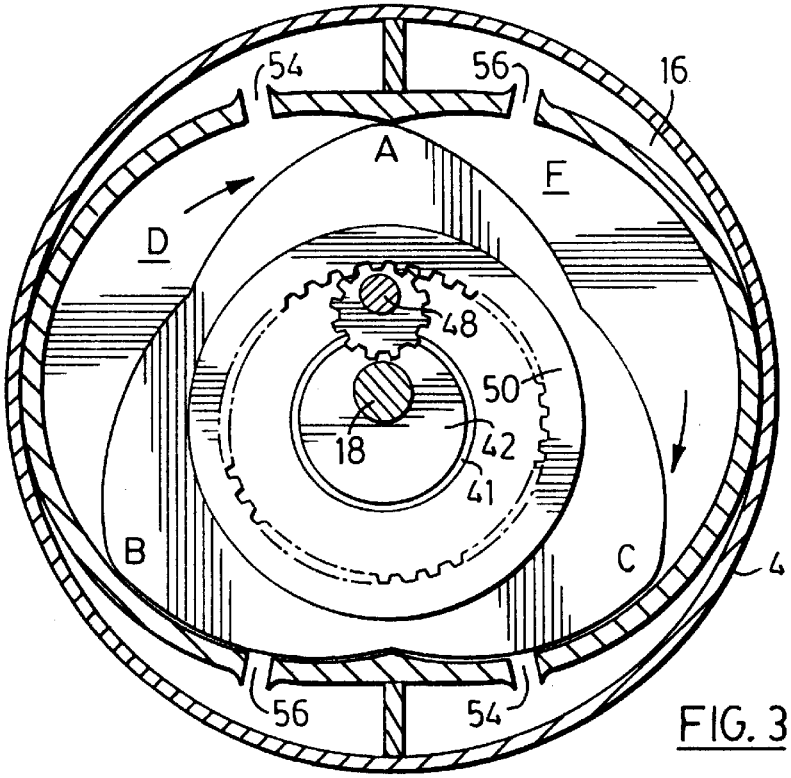
Figure 4:
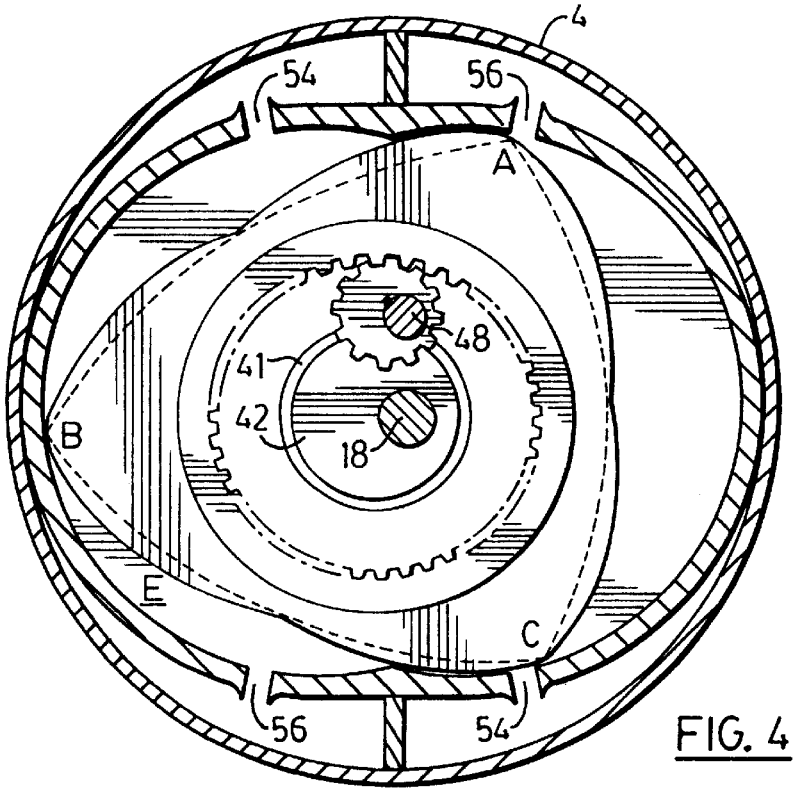
Figure 5:
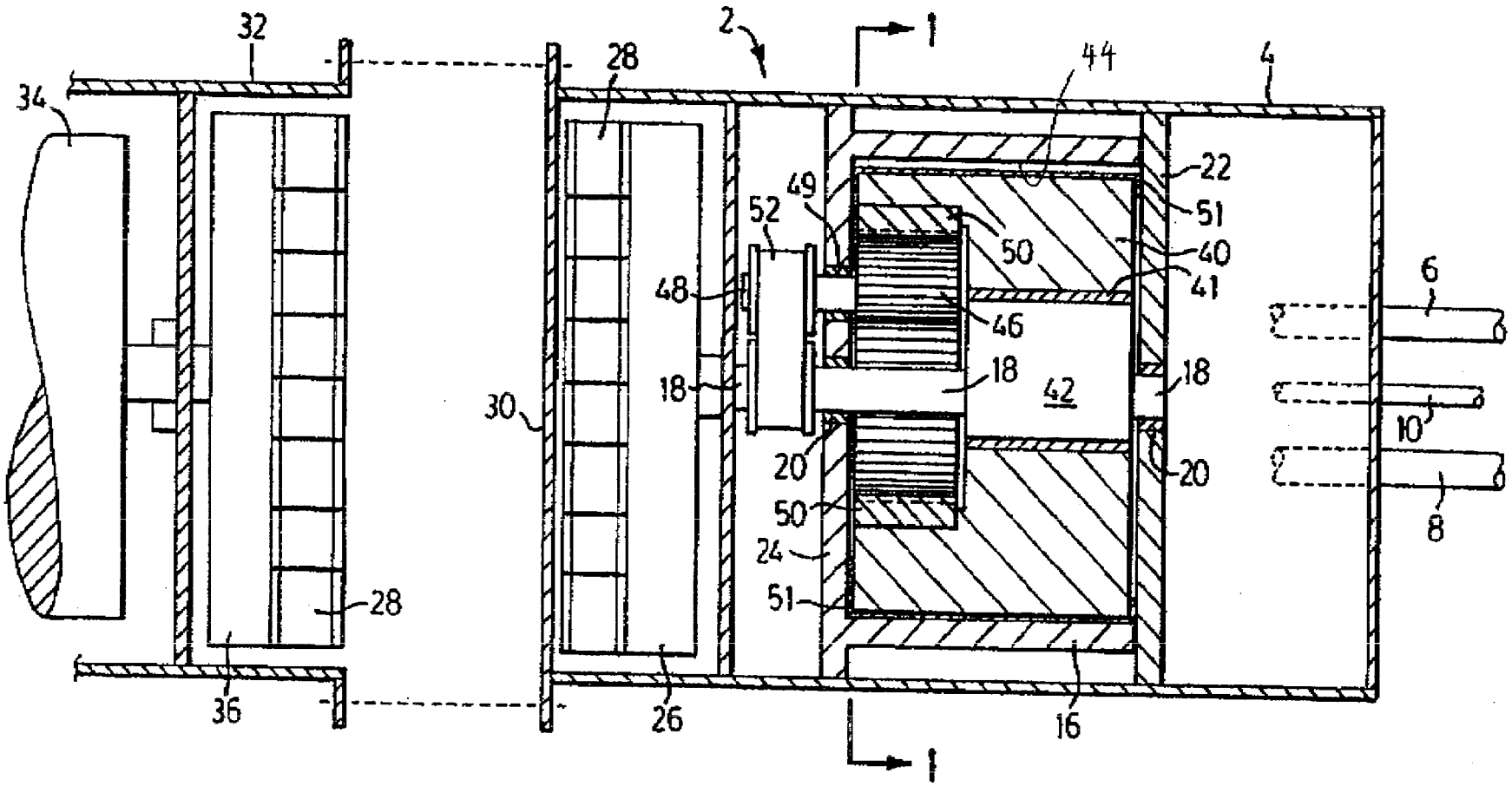

FIGS. 1–4 are cross-sectional views through a compressor in accordance with the invention, showing different phases of its operation, FIG. 1 being a section on the line 1—1 in FIG. 5; and FIG. 5 is a longitudinal section of the unit on the line 5—5 in FIG. 1, with the compressor and drive separated for clarity.

DESCRIPTION OF THE PREFERRED EMBODIMENT

Referring to FIG. 5, a compressor 2 comprises a casing 4 which is completely sealed apart from input and output pipes 6 and 8 which connect the compressor 2 respectively to the evaporator and the condenser (not shown) of a refrigeration unit. A third pipe 10 is used only to charge the unit with refrigerant and is then permanently sealed. Internally the pipes 6 and 8 are connected to chambers 12 and 14 respectively (see FIGS. 1–4) formed between the casing 4 and a stator 16 of the compressor, the chambers being separated by walls 38. A compressor drive shaft 18 is journalled in bearings 20 in end walls 22, 24 of the stator, and carries at one end a driven element 26 of a magnetic coupling which may for example consist of concentric rings of ceramic disc magnets 28 having alternating polarities at their faces adjacent an end plate 30 of the casing 4.

The end plate 30 is secured to a motor casing 32 which mounts a motor 34 coupled to a driving element 36 of the magnetic clutch, which is similar to the driven element 26 and supports faces of its magnets 28 adjacent the end plate 30. The coupling may advantageously be designed so that the torque it can transmit is insufficient to apply damaging overloads to the compressor or the motor. The motor may be selected to suit the application. For example alternating or direct current motors for operation at any desired voltage may be utilized, or higher or lower speed motors, or variable speed motors to provide to provide high, low or variable compressor output. The motor need not be electric; for example an internal combustion engine or even a clockwork or manually powered drive could be used. Since the motor is not within the sealed unit, it is simpler to arrange for its cooling, any heat produced can be kept away from the compressor, and the motor can be of cheaper construction, as well as being replaceable.

The compressor 2 utilizes features of construction which resemble features of the motor described in U.S. Pat. No. 5,310,325, the text and drawings of which are incorporated herein by reference. A trilobar rotor 40 is supported by a bearing 41 on an eccentric 42 mounted on the shaft 18 for orbital movement along a path within a trochoidal chamber 44 defined within the stator 16, through which path it is driven by an eccentric gear 46 fast on a shaft 48 journalled in the stator 16 by a bearing 49, which gear engages a ring gear 50 within the rotor 40. The rotor is sealed to the end walls 22, 24 by ring seals 51. The shaft 48 is driven by a belt 52 from the shaft 18, and together with the shaft 18 constitutes a rotary drive to the rotor 40 such that the eccentric 42 and eccentric gear 46 rotate synchronously. The ratio of the ring gear to the eccentric gear is equal to the number of lobes, in this case three, of the rotor, and the eccentricities of the eccentric 40 and the gear 46 are the same The stator 16 is formed with ports 54 and 56 communicating with the chambers 12 and 14 respectively. The ports 54 may be equipped with spring valves such as reed valves 58 to prevent unwanted reverse flow.

FIG. 1 shows the position of the rotor 40 when the maximum eccentricities of the eccentric 40 and gear 46 are directed upwardly (as seen in the drawing). The direction of rotation in this example is clockwise, and the apices of the lobes of the rotor are labeled A, B and C for convenient reference. The geometry of the rotor and stator and of the drive are such that the apices remain in contact with the wall of trochoidal chamber 44. Apex B contacts the wall between the lower ports 54 and 56, while the surface of the rotor between apices A and C lies against the chamber wall, obturating the upper ports 54 and 56. As the rotor moves clockwise, gas is drawn through the lower port 56 into the chamber labeled D, while gas in chamber E is compressed and forced out of the chamber through lower port 54 past valve 58 if its pressure exceeds that in chamber 14.

Figure 2:
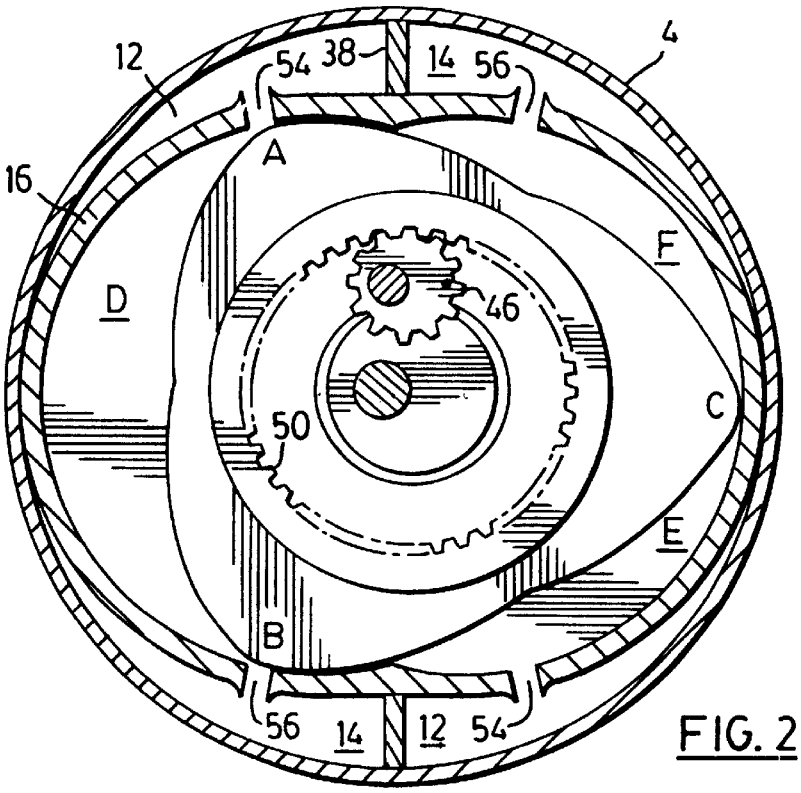

As the rotor reaches the position shown in FIG. 2, apex B moves past lower port 56 cutting off the induction of gas into chamber D and then apex A moves past upper port 54 so that gas compressed in chamber D on further motion of the rotor can pass through that port once Rs pressure exceeds that in chamber 14 At the same time, that portion of the rotor between apices A and C moves away from the stator forming chamber F into which gas is induced through upper port 56, and pressurized gas continues to be expelled through lower port 54 from chamber E.

In FIG. 3, the position is analogous to that in FIG. 1, except that apex A lies between upper ports 54 and 56, and lower ports 54 and 56 are obturated by the surface of the rotor between apices B and C. In FIG. 4 the position is analogous to that in FIG. 2, with chamber F filled, chamber E refilling, and compressed gas being expelled from chamber D. When the eccentric again reaches the position shown in FIG. 1, the rotor has turned through 120 degrees and a similar sequence is then repeated. After three sequences, the rotor has turned through 360 degrees. In effect, three compression cycles are occurring simultaneously, 120 degrees out of phase, providing high volumetric efficiency and a very smooth action.

Particularly if at least one of the rotor and the stator is molded from synthetic plastic, it may be possible to dispense with apex seals, thus further simplifying construction. The use of an external motor means that the latter may also power other functions of apparatus including a refrigeration unit incorporating the compressor, for example mixing paddles in an icecream maker The compactness of the equipment suits it for use in portable applications such as refrigerated protective clothing.

Although a particularly preferred embodiment of compressor has been described, other forms of compressor using rotors orbiting in trochoidal chambers may be utilized, as may scroll compressors.

I claim:

1. A compressor for a refrigeration unit comprising:

a sealed casing having at least one inlet port for receiving refrigerant gas and at least one discharge port for discharging compressed refrigerant gas, a stator enclosed by the sealed casing and defining a chamber in communication with the at least one inlet port and the at least one discharge port, a rotor enclosed by the sealed casing, the rotor orbiting in a chamber defined within the stator and being in engagement with the stator to cyclically receive refrigerant gas through the at least one inlet port into the chamber, compress the refrigerant gas within the stator, and discharge the compressed refrigerant gas through the at least one discharge port, a rotary drive enclosed by the sealed casing and orbiting the rotor, a driven element of a magnetic coupling in driving connection with the rotary drive and orbiting the rotor, the driven element enclosed by the sealed casing and including at least one magnet, a driving element of the magnetic coupling outside of the casing in close proximity to the driven element, and an arrangement for rotating the driving element.

2. A compressor according to claim 1, wherein the rotor is a multilobed rotor orbiting within a trochoidal chamber.

3. A compressor according to claim 2, wherein the rotor is a three lobed rotor journalled on an eccentric carried by a shaft of the rotary drive and has a ring gear driven by an eccentric gear, the eccentric gear having the same eccentricity as the eccentric and being constrained to rotate in synchronism therewith, the gear ratio of the ring gear to the eccentric gear being three to one.

4. A compressor according to claim 1, wherein the arrangement for rotating the driving element includes an electric motor.

5. A compressor according to claim 1, wherein the magnet includes a plurality of permanent magnets.

6. A compressor according to claim 5, wherein the driving element includes a plurality of permanent magnets.

* * * * *